343-909 SR
11/30/76 XR 3,995,274

United States Patent [19]
Schwartz et al.
[11] 3,995,274
[45] Nov. 30, 1976

[54] CYLINDRICALLY SHAPED LEAKY WAVE ANTENNA

[75] Inventors: Leonard Schwartz, Montville, N.J.; Edward Chin, Rego Park, N.Y.; Myron Rosenthal, Wayne, N.J.

[73] Assignee: The Singer Company, Little Falls, N.J.

[22] Filed: Aug. 21, 1975

[21] Appl. No.: 606,657

[52] U.S. Cl. ..... 343/771; 343/783; 343/909

[51] Int. Cl.[2] ..... H01Q 13/10

[58] Field of Search ..... 343/771, 854, 783, 909

[56] References Cited

UNITED STATES PATENTS

| | | | |
|---|---|---|---|
| 2,605,413 | 7/1952 | Alvarez | 343/854 |
| 3,039,098 | 6/1962 | Bickmore | 343/771 |
| 3,680,140 | 7/1972 | Chalfin et al. | 343/754 |

*Primary Examiner*—Eli Lieberman
*Attorney, Agent, or Firm*—T. W. Kennedy

[57] ABSTRACT

A cylindrically shaped leaky wave antenna utilizing a cylindrically shaped printed grid antenna fed by a curved wave guide feed array utilizing anti-phase edge cut slots cut in accordance with a phase synthesis technique to provide a desired squinted beam resulting in a low cost conformal antenna without the use of active phase elements.

11 Claims, 5 Drawing Figures

CYLINDRICALLY SHAPED LEAKY WAVE ANTENNA

BACKGROUND OF THE INVENTION

This invention relates to antennas in general and more particularly to an antenna for radiating high frequency electromagnetic energy such that the energy is confined to form a highly directional beam.

In U.S. Pat. No. 3,721,988 a leaky wave guide planar array antenna is disclosed. This planar array produces four squinted beams used for an airborne doppler navigation system. The antenna includes a pair of slotted feed rectangular wave guides arranged to permit input energy to be applied at any one of four ports. Interconnecting and coupled to the feed wave guides by means of slots and feed wave guides is a radiating member which includes a leaky grid structure through which beam forming electro-magnetic energy is radiated. In that arrangement, each port into one of the slotted arrays is used to generate a single beam. Clearly where only one or two beams are required the same technique can be used.

Although that antenna operates quite well and provides a low cost approach, it suffers from one disadvantage. The antenna is a planer array and if it were to be used as a conformal antenna for use as a tracking systm on missiles and artillery shells, or the like it, would require a conformal radome.

Clearly in such applications i.e., for use with tracking systems on missiles and artillery shells, there is a need for a low cost conformal antenna. Direct application of the antenna disclosed in U.S. Pat. No. 3,721,988 would increase the cost because of the need for the extra conformal radome. One approach to constructing a conformal wave guide would be to use a slotted wave guide planar array such as that disclosed in U.S. Pat. No. 3,276,026. However in using such an array curved slotted wave guides must be used. It is well known that such a curved array requires a phase synthesis technique in its design. Typically such has been accomplished in the prior art through the use of active phase elements.

Other applications require a conformal antenna array which generates a pencil beam. Again such a conformal array will have curved surfaces and will require a phase synthesis technique in designing to obtain the desired output beam. Typically such an array may be desired in a spherical configuration.

In view of this it becomes evident that there is a need for an improved technique for constructing antennas which utilize curved wave guides, in particular those using slotted wave guides which avoids the need for active phase elements thereby permitting a simpler antenna construction in a conformal configuration.

SUMMARY OF THE INVENTION

The present invention provides a cylindrically shaped conformal antenna which uses a novel phase synthesis technique along with the basic type of construction disclosed in prior U.S. Pat. No. 3,721,988 to provide a conformal cylindrical radiating grid.

The phase synthesis technique used is one in which the required phase function as a function of arc length is determined and plotted. Over this curve the required phase differential is super-imposed. The slot locations are then selected at the intersection of the running phase lines and the required function. In this manner total phase correction is obtained An antenna for generating a single beam is disclosed which finds particular application to missiles, artillery shells and the like. Also disclosed is a manner in which two squinted beams may be obtained. Such an antenna may find application in Doppler navigation systems which require only two such beams such as those in a low cost low performance system which receives vertical velocity components from another device.

DETAILED DESCRIPTION OF THE PREFERRED EMBODIMENT

Figure 1:
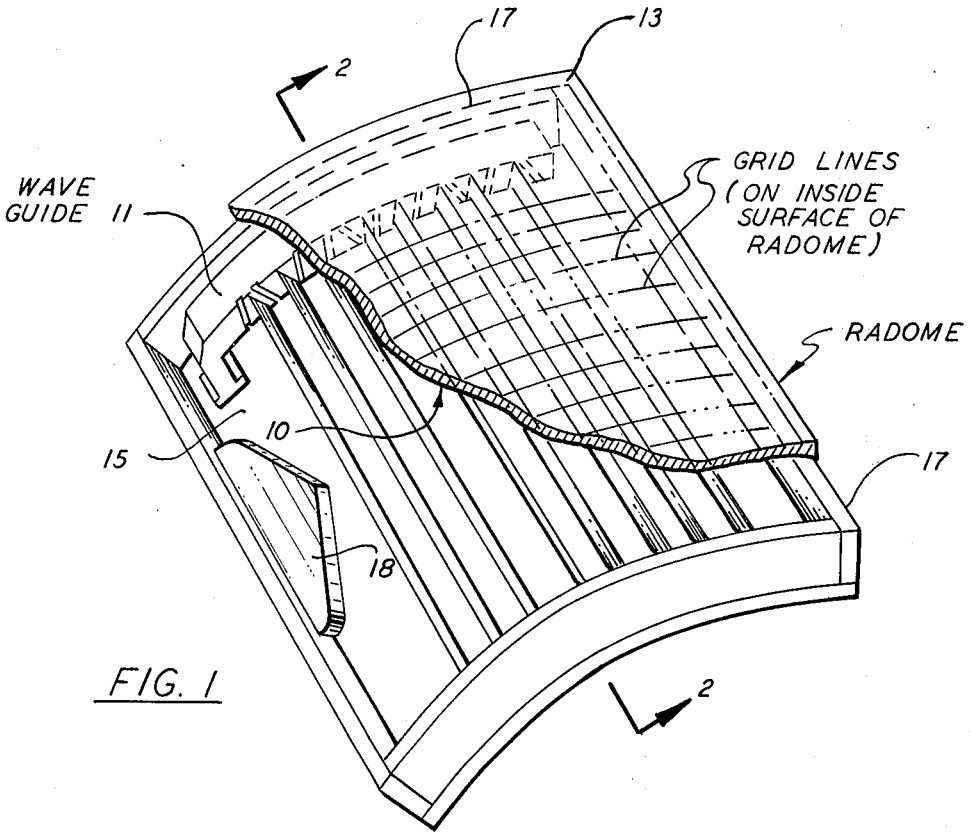
FIG. 1 is a perspective view partially cut-away of cylindrical radiating grid antenna constructed according to the present invention.
Figure 2:
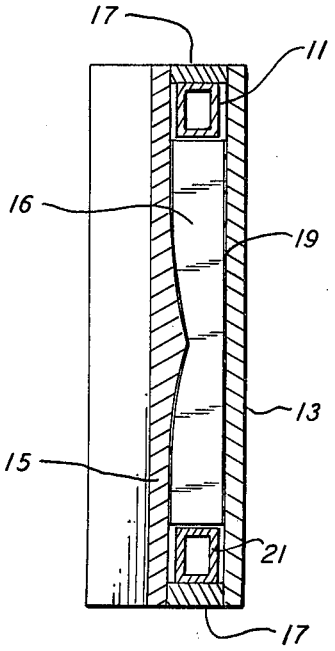
FIG. 2 is a longitudinal cross section through the antenna of FIG. 1.
Figure 3:
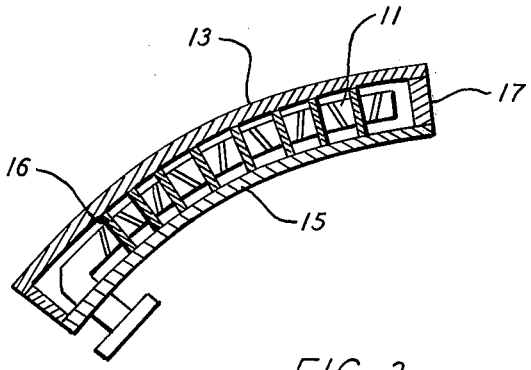
FIG. 3 is a lateral cross section of the antenna of FIG. 1.

FIG. 1 illustrates a perspective cut away view of the cylindrical conformal leaky wave guide of the present invention. It includes a curved slotted wave guide feed array 11 having slots 35 located between concentric cylindrical plates 13 and 15. The outer cylindrical plate 13 is a leaky grid consisting of metal strips photo-etched on one side of a dielectric plate. This is an integral part of the antenna and serves as the conformal radome. The bottom portion 15 is a reflector surface and is contoured as shown on the cross sectional view of FIG. 2. Closing the antenna are four sidewalls 17. Also shown along one of the side walls is a microwave absorber 18 for selective reduction of the intensity of undesirable reflections. Another of these will be provided on the opposite side wall 17. Thin metal strips 16 are provided extending radially between pairs of slots 35 to act a metallic separators. With the exception of its cylindrical shape, and in the construction of wave guide 11, the antenna is identical to that disclosed in U.S. Pat. No. 3,721,988 and may be constructed in accordance therewith. The cross sectional view of FIG. 2 also illustrates the grid 19 on the bottom of the radome surface 13 along with illustrating an optional second wave guide 21. This second wave guide may be installed and operated to produce a second beam in the manner that additional inputs are provided to the antenna of the aforementioned patent. FIG. 3 shows a cross section of the antenna looking toward wave guide 11.

Figure 4:
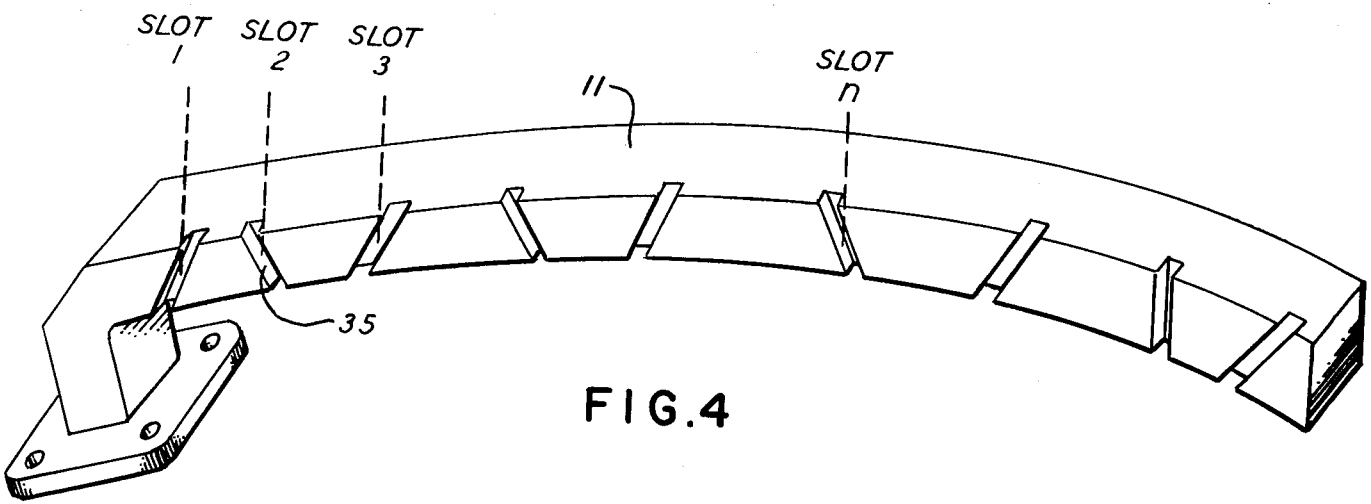
FIG. 4 is a perspective view of the wave guide of the antenna of FIG. 1.
Figure 5:
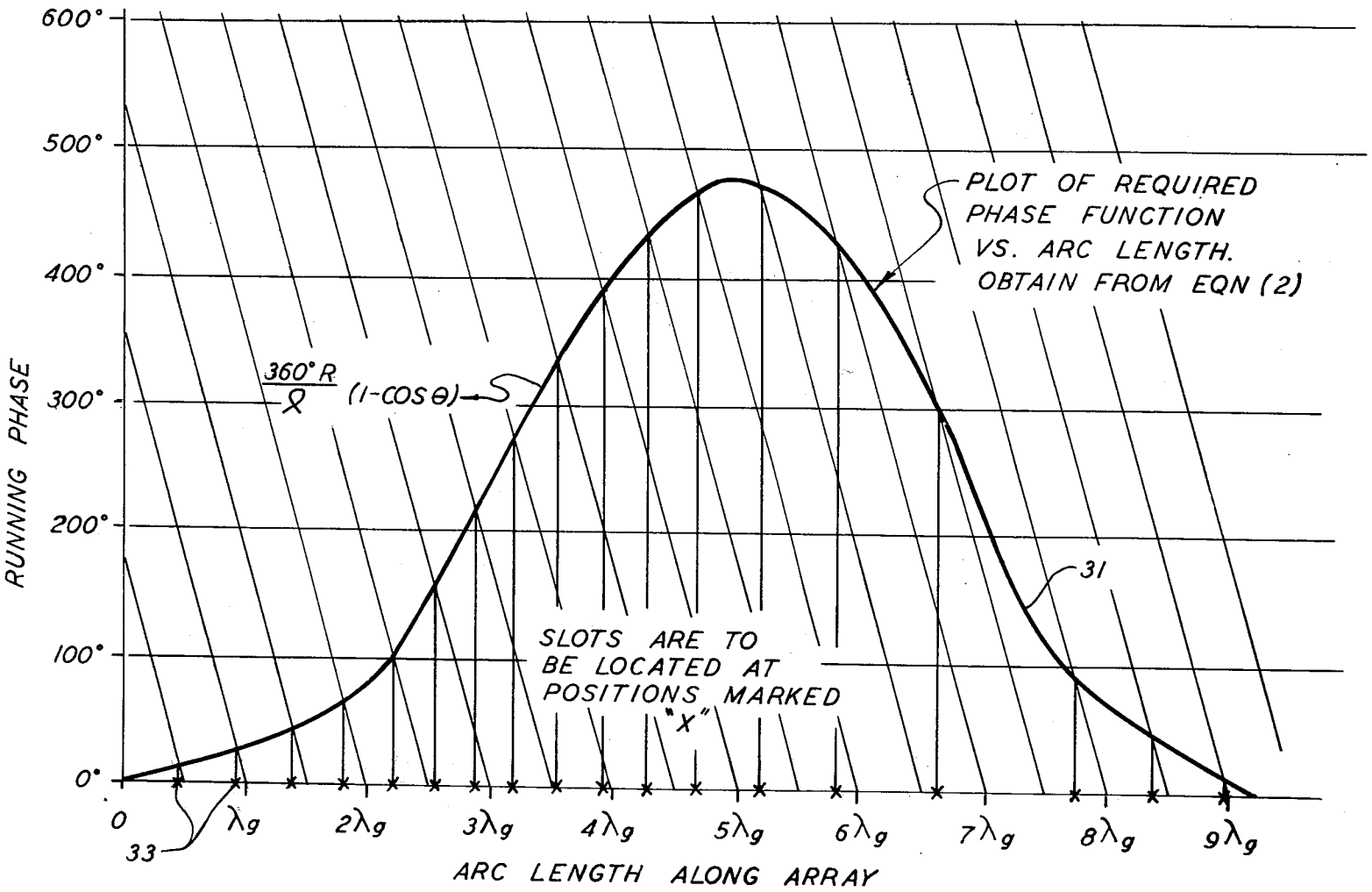
FIG. 5 is the curve used in the synthesis of the wave guide of FIG. 4.

A perspective view of the wave guide 11 of the present invention is shown on FIG. 4 and the curve used in synthesis this wave guide on FIG. 5. As with any curved feed array, a phase synthesis technique is required. By using anti-phase edge cut slots, this synthesis is implemented using a variable slot spacing array. In the aforementioned U.S. Patent the wave guide feed array has equal slot to slot spacings. However such is not possible with the curved wave guide of the present invention.

The pattern formation for the proposed antenna may be approximately represented by the product of two orthogonal functions:

$$F(\theta,\phi) = F(\theta)\,F(\phi) \qquad (1)$$

where $F(\theta,\phi)$ is the composite radiation pattern of the array, and where $F(\theta)$=radiation pattern of the grid and $F(\phi)$=radiation pattern of the curved feed.

The antenna technology described in the aforementioned U.S. Patent is directly applicable to the design of the grid used in the cylindrical antenna and will not be described in detail herein.

It is a well known fact that antenna apertures which are circularly curved require a phase correction in the direction of curvature equal to:

$$\delta = R(1 - \cos\phi)\,\frac{2\pi}{\lambda} \qquad (2)$$

(2)

where $\lambda$ = the wavelength

R = the radius of curvature of the surface $\phi$ = the angular location on the circle.

Thus it is apparent that a variable phase correction is required about the circular curvature.

The radiating grid described in the aforementioned U.S. Patent requires parallel polarization incident on the grid lines. In order to obtain this, edge cut slotted wave guide arrays can be used. Because wave guide arrays are travelling wave arrays, it is possible to offset the phase differential required and given by equation (2) above. Since an additional 180° phase reversal may be obtained by reversing the orientation of the slot inclination, it is possible by minimizing the spacing between slots to more accurately implement the phase difference given in equation (2). The manner in which this can be done is illustrated on FIG. 5. The running phase as a function of arc length along the wave guide is first plotted as a plurality of parallel lines. What is meant by running phase is the phase of a wave propagating through the wave guide at various points therealong with respect to its phase at the input of the wave guide. Superimposed on this is the phase function 31 described by equation (2) above. By choosing the slot locations at the intersections of the running phase lines and the required function, total phase correction is obtained, i.e., the use of the anti phase array permits each such intersection to be used. Thus, slots must be located at the points indicated by the X's 33 along the bottom of the graph. The antenna of FIG. 4 is shown having slots 35 on the wave guide 11 spaced in accordance with a function such as that shown on FIG. 5. The phase at any slot is equal to:

$$\delta N = \frac{-2\pi}{\lambda_o} S_\eta + (N-1)\pi$$

where $S_\eta$ = Arc distance of slot N measured from slot 1.

Because of the cylindrical characteristic of the antenna array the grid design is indentical to that of a rectangular array such as that described in the described U.S. Pat. No. 3,721,988. In contrast to that antenna the present one does include metallic separators 16. During test, it was discovered that the antenna pattern performance could be improved by adding metallic separators 16 inside the cavity of the antenna as shown in FIG. 1.

It is thought that the separtors improve the antenna pattern performance because the separators constrain the energy radiated by the slots from superimposing with that of the adjacent slots. As noted above, the spacing between the slots on the curved feed are varied to correct for the curvature of the cylinder. However, it is believed that prior to the radiation of the energy into free space, the energy radiated by the slots is vectorically combined while still inside the antenna cavity. Thus, without separators, when the energy is finally radiated into free space, the phase relationship across the curved surface is no longer exactly as predicted.

With the separators, the energy radiated by the slots is confined to the channels thus formed by two adjacent separators and, as a result, the phase relationship across the curved surface is exactly as predicted and for which the correction in the feed was designed for.

It should be noted that it is not necessary to insert separators 16 between each pair of slot. Several slots may be grouped within one channel formed by two separators. Of course, the isolation will be less in that event.

The separators, in addition to providing the isolation mentioned above, have another advantage. By using the separators, the distance between the grid and reflector can be accurately maintained. Thus, the separators eliminate the need for radome support spacers. The separators can be accurately positioned by inserting them in grooves machined into the reflector.

For more background in regard to slotted arrays such as that of FIG. 4 reference may also be had to U.S. Pat. No. 3,604,010.

Thus, an improved cylindrical conformal antenna has been shown, although a specific embodiment has been shown and described, it will be obvious to those skilled in the art that various modifications may be made without departing from the spirit of the invention which is intended to be limited solely by the appended claims.

What is claimed is:

1. In a conformal array antenna comprising wave guide means for radiating a beam including an elongated radiating wave guide for leaking energy continuously along its length to form said beam, said radiating wave guide including a first wall having a plurality of parallel metal strips and a second wall having varied spacing from said first wall along the length of said radiating wave guide; and wave guide means for feeding energy to said radiating wave guide having a plurality of slots, communicating with said radiating wave guide to couple energy from said wave guide means to said radiating wave guide, said wave guide means having an input port for coupling said antenna to a source of energy, the improvement comprising:

a. the first and second walls curved to form a segment of a cylinder;

b. the wave guide means for feeding energy having a plurality of slots of unequal spacing, with the slot location selected from a plot of the intersection of a line representing the phase of a propagating wave at various points along the wave guide with respect to the phase at the input to the wave guide means and a required function representing the type of beam to be generated.

2. The invention of claim 1 wherein energy absorbing means are mounted in said radiating wave guide for reducing the intensity of undesirable reflections within the structure in order to improve patterns.

3. The invention of claim 1 wherein one wall of each of said two elongated feeder wave guides is formed by a strip of metal photoetched on a laminate.

4. The invention of claim 1 wherein a plurality of metal strips are arranged orthogonally with said parallel metal strips for reducing cross-polarization.

5. The invention of claim 1 and further including an additional wave guide means having an additional port for coupling said antenna to a source of energy said additional wave guide means having a plurality of slots with slot locations at the intersection of its running phase lines and a different function, whereby a first beam can be generated by coupling to said wave guide means and a second beam by coupling to said additional wave guide means.

6. The invention of claim 5 wherein said slots in said wave guide means and additional wave guide means are anti-phase cut slots.

7. the invention of claim 6 wherein said wave guide means and additional wave guide means are bent in the H plane and said slots are edge cut slots.

8. The invention of claim 1 wherein said slots are antiphase cut slots.

9. The invention of claim 8 wherein said wave guide means is bent in the H plane and said slots are edge cut slots.

10. The invention of claim 1 and further including a plurality of metallic separators extending radially between said walls separating groups of slots.

11. The invention of claim 10 wherein a metallic separator is installed between each pair of slots.

* * * * *